United States Patent [19]

Akutsu et al.

[11] Patent Number: 4,765,118

[45] Date of Patent: Aug. 23, 1988

[54] APPARATUS FOR WELDING A STRIP OF TAPE TO FILM

[75] Inventors: Masami Akutsu, Kasukabe; Tsutomu Kamojima, Takaoka; Noboru Hirasawa, Tokyo, all of Japan

[73] Assignees: Kureha Chemical Industry Company Limited, Tokyo; Toyama Sanki Company Limited, Toyama, both of Japan

[21] Appl. No.: 75,343

[22] Filed: Jul. 20, 1987

[30] Foreign Application Priority Data

Aug. 7, 1986 [JP] Japan ..... 61-186643

[51] Int. Cl.[4] ..... B65B 61/18

[52] U.S. Cl. ..... 53/133; 156/519; 493/212; 493/377; 493/380; 53/389; 53/551

[58] Field of Search ..... 53/133, 551, 389; 156/519; 493/212, 224, 377, 380, 393

[56] References Cited

U.S. PATENT DOCUMENTS

| | | | |
|---|---|---|---|
| 2,204,369 | 6/1940 | Leary | 156/519 |
| 2,880,656 | 4/1959 | Welsh | 493/393 X |
| 3,311,032 | 3/1967 | Lucas | 156/519 X |
| 3,681,890 | 8/1972 | Pringle | 53/133 X |
| 3,879,246 | 4/1975 | Walker | 156/519 X |
| 4,701,239 | 10/1987 | Craig | 156/519 |

FOREIGN PATENT DOCUMENTS

| | | | |
|---|---|---|---|
| 2930231 | 2/1981 | Fed. Rep. of Germany | 493/212 |

*Primary Examiner*—John Sipos

*Attorney, Agent, or Firm*—Koda and Androlia

[57] ABSTRACT

The apparatus for welding a strip of tape to film includes a tape feed roller for feeding the film continuously and a welding roller disposed in a position where the film is held between both the rollers, both the rollers being rotated in synchronism with each other. The tape is held onto the outside periphery of the tape feed roller and is cut into a strip by a cutting member. The tape is fed to be overlapped on the film while being held onto the tape feed roller. The film and the tape are held between the tape feed roller and the welding roller and the tape is welded to the film in spaced manner by a welding member provided with the welding roller.

6 Claims, 9 Drawing Sheets

(B2)

APPARATUS FOR WELDING A STRIP OF TAPE TO FILM

BACKGROUND OF THE INVENTION AND RELATED ART STATEMENT

The present invention relates to an apparatus for welding a strip of tape to film, and more particularly to an apparatus for cutting the tape into a strip to weld it to a casing film for packing processed foodstuffs such as sausage into a sticklike shape and tear off the film by the strip of tape.

The processed foodstuffs such as sausage and sticklike cheese are packed by a casing film formed of vinylidene chloride into a cylindrical shape and both ends of cylindrical casing film are clamped with aluminum wires. In such film packed sticklike processed foodstuffs, a knife is required to open or cut the casing film packing the processed foodstuffs and accordingly it is inconvenient to a consumer. There are film packed sticklike processed foodstuffs having a cut tape welded to the casing film to facilitate opening or cutting of the film, while the cut tape has been provided over the whole length in the longitudinal direction of the sticklike package heretofore. Accordingly, the long cut tape is required and is expensive.

Heretofore, the cut tape is welded to the casing film of the sticklike package over the whole length thereof along the junction of opposed ends of the casing film formed into a cylinder.

However, the cut tape welded to the casing film over the whole length thereof is hardly picked up by fingers to remove the casing film from the sticklike processed foodstuffs. Further, even if the cut tape is pulled by fingers, the casing film can not be torn and removed easily, but the sticklike processed foodstuffs is bent.

It is an object of the present invention to provide an apparatus for welding a cut tape to a casing film packing sausage and the like so as to facilitate removal of the film.

It is another object of the present invention to provide an apparatus for welding a cut tape to a casing film in which the cut tape for removing the casing film can be used inexpensively and effectively.

It is still another object of the present invention to provide an apparatus for welding a cut tape to a casing film in place without positional deviation.

SUMMARY OF THE INVENTION

An apparatus according to the present invention comprises means for successively feeding film used for packing processed foodstuffs and a tape feeding roller opposed to one side of the film being fed and including a peripheral surface provided with a function to holding a tape on the surface in sucked manner, the tape being held on the tape feeding roller in sucked manner and being cut into a strip by a cutter. Further, there is provided a welding roller opposed to the tape feeding roller so that the film is held between both the rollers and including a welding member disposed on a peripheral surface for welding the film and the tape to each other, and when the strip of tape held on the tape feeding roller is brought into contact with the film being fed, the tape is welded to the film by the welding roller.

DETAILED DESCRIPTION OF PREFERRED EMBODIMENT

Figure 1:
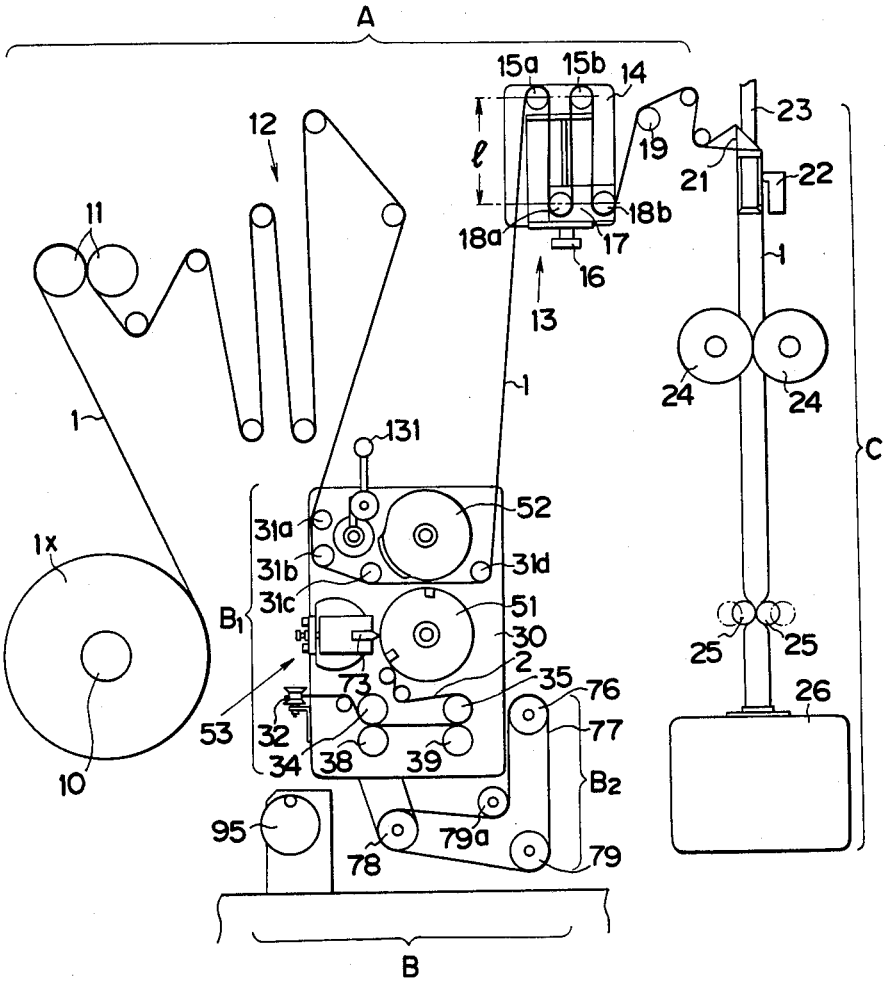
FIG. 1 is a front view illustrating a combined processing apparatus of a welding device which welds a strip of tape to film and a packing and filling device which manufactures a sticklike package such as sausage.

FIG. 1 illustrates a whole configuration of a processing apparatus for processed foodstuffs including a device for welding a strip of tape to film according to the present invention.

The apparatus comprises a film feeding device A which successively feeds long film 1, a welding device B which cuts a tape 2 into a strip to weld the cut tape 2 to the film 1, and a filling and packing device C which forms the film 1 into a cylinder in sealed manner and fills processed meat into the cylinder to manufacture sticklike sausage and the like. All of the devices A to C are disposed on a common base and configure one system as a whole.

The welding device B comprises a processing mechanism $B_1$ which cuts the tape and welds the tape to the film, and a power transmission mechanism $B_2$ which transmits power to the processing mechanism $B_1$. A motor is employed in common as a power source of the power transmission mechanism $B_2$ and a power source of the filling and packing device C.

The film feeding device A comprises a support roller 10 which supports a film roll 1*x* of the film 1. The film 1 is pulled out from the film roll 1*x* by a pair of feeding rollers 11 at a predetermined speed and is guided by guide rollers 12 so that the film 1 is fed to the welding device B continuously. The film 1 to which strips of tape 2*a* are welded by the welding device B is fed to the filling and packing device C through a phase adjusting mechanism 13 and guide rollers 19.

The phase adjusting mechanism 13 comprises fixed rollers 15*a* and 15*b* provided on a base 14 and moving rollers 18*a* and 18*b* provided on a moving base 17 which moves up and down. When an adjustment knob 16 is rotated, the moving base 17 can be moved up and down to vary a distance l between the fixed rollers 15*a*, 15*b* and the moving roller 18*a*, 18*b* to adjust the length of the film extending between the welding device B and the filling and packing device C.

The filling and packing device C comprises a forming device 21 which forms the film 1 to which the strips of tape 2*a* have been welded by the welding device B into a cylindrical shape, a high-frequency electrode 22 which sealingly joins opposed ends of the film 1 formed into a cylinder, and a stuffer nozzle 23 which fills processed meat into the cylindrical film 1. In the filling and packing device C, the film 1 is continuously fed by feed rollers 24 at a fixed speed and is squeezed through squeezing rollers 25 at predetermined intervals. Then, the squeezed cylindrical film 1 filled with the processed meat is fastened at the squeezed portions with clips 4 by a clipping mechanism 26 while the clips are wound around the squeezed portions, and the fastened cylindrical film 1 is cut at the squeezed portion for each package to manufacture sticklike processed meat such as sausage.

The structure of the welding device B which welds the strip of tape to the film and constitutes a characteristic feature of the present invention is now described.

Figure 2:
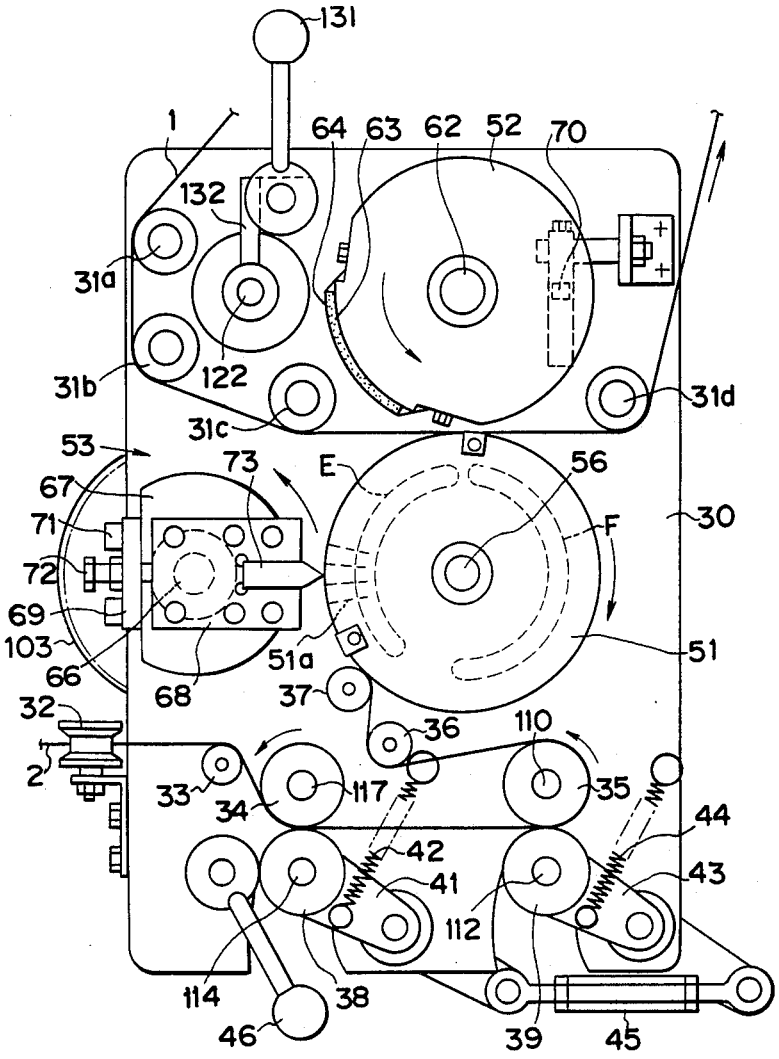
FIG. 2 is a front view of a mechanism of the welding device of the tape to the film as viewed from a surface side of a unit base.
Figure 3:
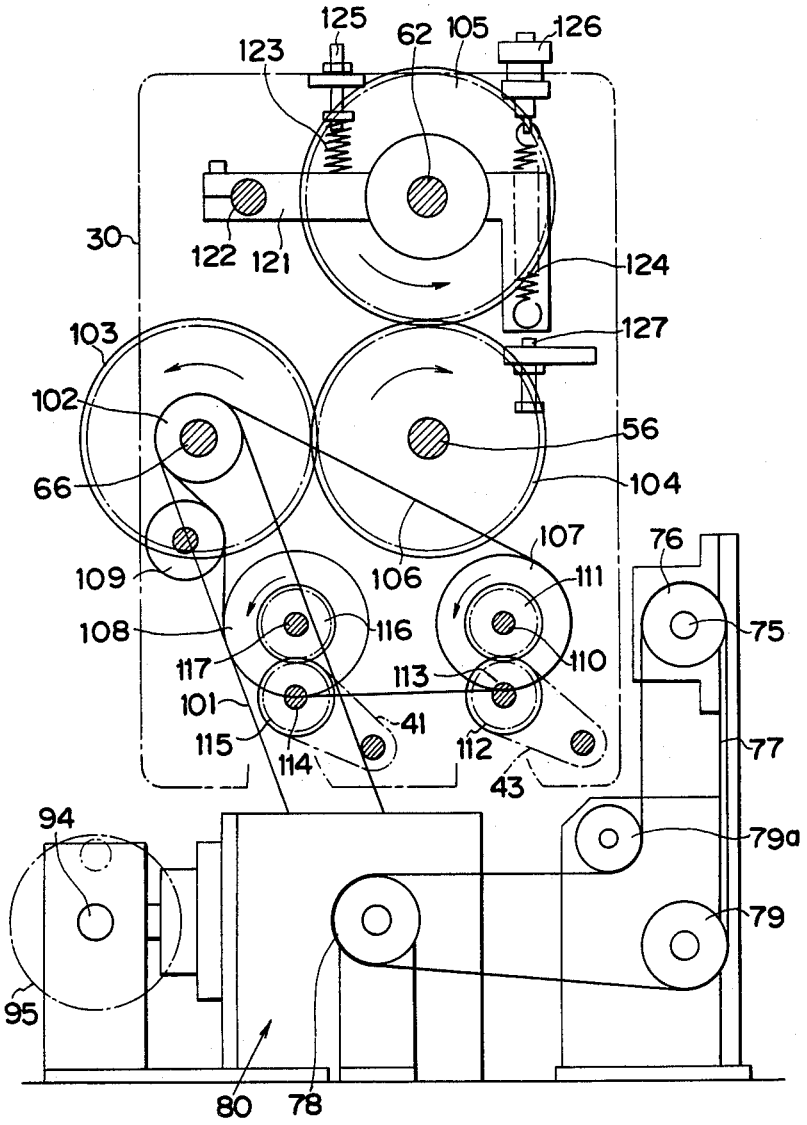
FIG. 3 is a front view of a power transmission mechanism of the welding device as seen through the unit base.

FIG. 2 is a front view showing the structure of the processing mechanism $B_1$ of the welding device B and FIG. 3 is an opened-up front view of the power transmission mechanism $B_2$ of the welding device B as viewed from the same direction as in FIG. 2.

The processing mechanism $B_1$ shown in FIG. 2 is disposed on a surface of a unit base 30.

The film 1 fed by the film feeding device A is led by four guide rollers 31*a* to 31*d* in the processing mechanism $B_1$ and is then sent out in the right direction in the figure. The film 1 is moved substantially horizontally between the guide rollers 31*c* and 31*d*.

The elongated tape 2 is pulled out from a film roll disposed before the unit base 30 and is led horizontally in FIG. 2. The tape is further guided by a roller 33 and is applied with feeding power by a pair of feed rollers 34 and 35, the tape 2 being further sent out upward in the figure by rollers 36 and 37. The feed rollers 34 and 35 are opposed to pinch rollers 38 and 39, respectively. The pinch roller 38 is supported to a lever 41 and is urged to be pressed to the feed roller 34 by a spring 42 resiliently. Similarly, the pinch roller 39 is supported to a lever 43 and is urged to be pressed to the feed roller 35 by a spring 44 resiliently. The pair of feed rollers 34 and 35 are both rotated counterclockwise by the tower transmission mechanism $B_2$ described later. However, the rotational speeds of both the feed rollers 34 and 35 are not the same, and the rotational speed of the right-hand feed roller 35 is adapted to be slightly larger than that of the left-hand feed roller 34. The tape 2 is fed while being tensioned slightly by the difference between both the rotational speeds of the rollers 34 and 35 so that creases, if any, are removed. The pinch roller 38 is rotated clockwise in synchronism with the feed roller 34 and the pinch roller 39 is also rotated in synchronism with the feed roller 35. The levers 41 and 43 of the pinch rollers 38 and 39, respectively, are coupled with each other through a joint 45 behind the unit base 30. The angular movement of a separation arm 46 mounted in the unit base 30 can separate both the feed rollers 34 and 35 from the pinch rollers 38 and 39 simultaneously.

A tape feed roller 51 is disposed under the film 1 being fed while extending between the pair of guide rollers 31*c* and 31*d*, and a welding roller 52 is disposed above the film 1 in opposing relationship with the film 1. A cutting device 53 which cuts the tape 2 into a strip is mounted at the left side of the tape feed roller 51. The tape feed roller 51 is rotated clockwise and the welding roller 52 and the cutting device 53 are rotated counterclockwise in synchronism with the roller 51 by the power transmission mechanism $B_2$.

Figure 4:
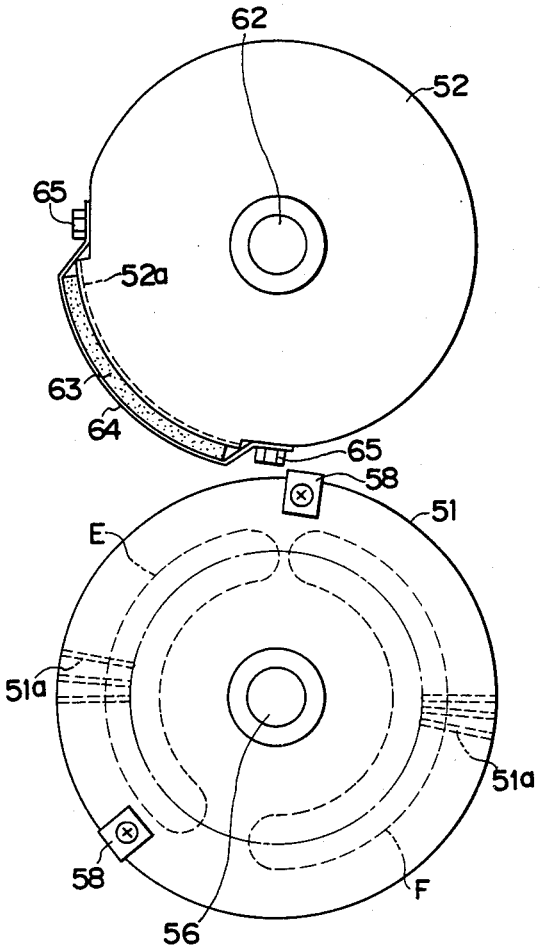
FIG. 4 is a front view showing a tape feeding roller and a welding roller.
Figure 5:
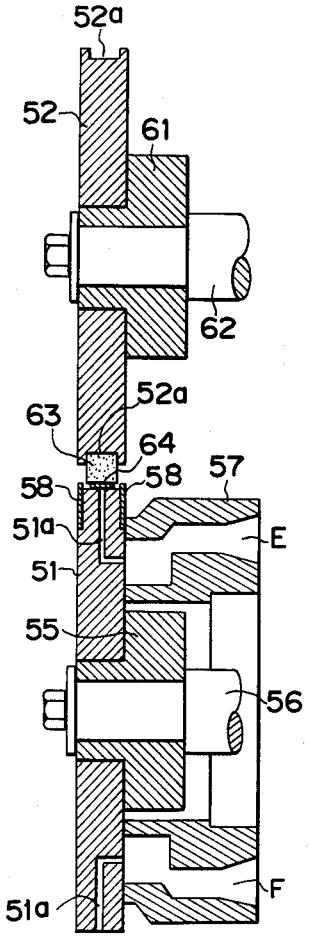
FIG. 5 is a longitudinal sectional view of the tape feeding roller and the welding roller.
Figure 6:
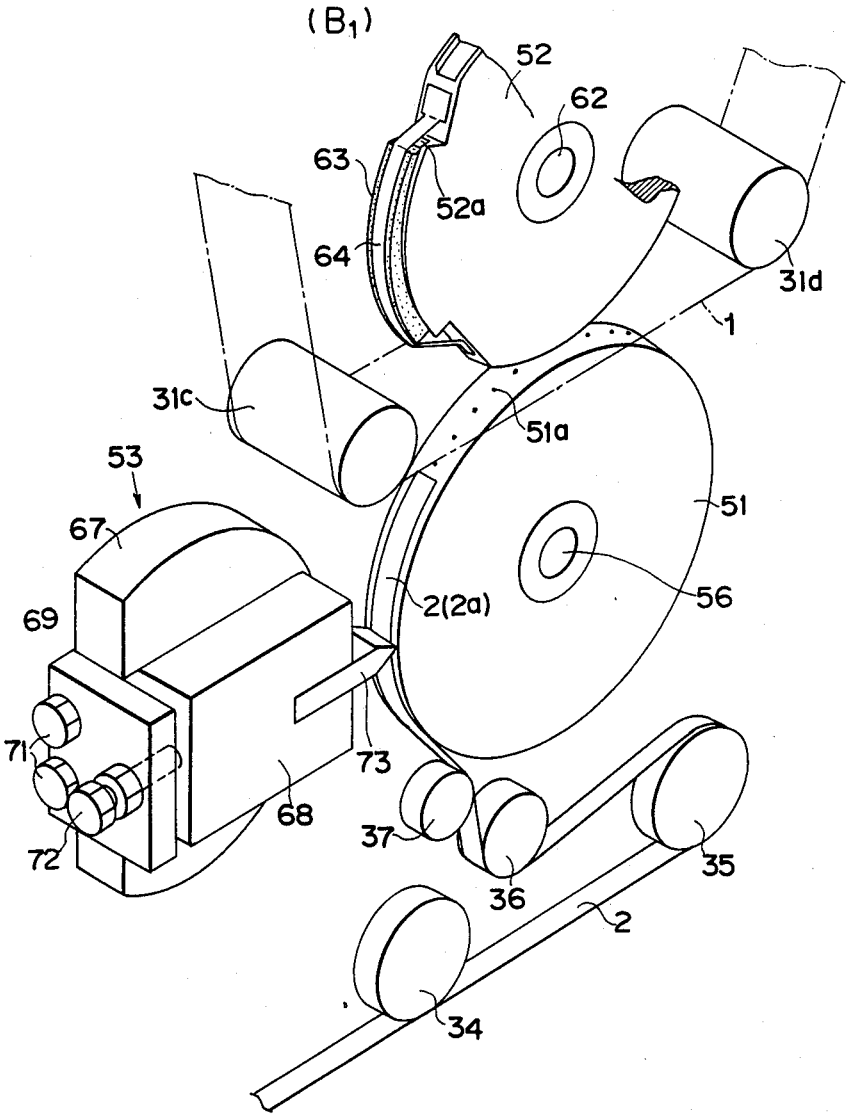
FIG. 6 is a perspective view of the tape feeding roller and the welding roller illustrating the welding operation of the strip of tape to the film.

FIG. 4 is an enlarged front view showing the tape feed roller 51 and the welding roller 52. FIG. 5 is a longitudinal sectional view of both the rollers 51 and 52 as cut at the angle in which the main portion thereof can be understood. FIG. 6 is a perspective view showing the tape feed roller 51, the welding roller 52 and the cutting device 53.

As shown in FIGS. 4 and 5, the tape feed roller 51 is supported at its rear surface by a support member 55, which is fixedly mounted to a drive shaft 56. The roller 51 is formed with a number of communicating holes 51*a*. While only the several holes 51*a* are shown in FIG. 5, the holes 51*a* are formed over the whole periphery at intervals of a fixed angle. The holes 51*a* are formed in the form of L in section as shown in FIG. 5 and include one end opening at the periphery of the roller 51 and the other end opening at the rear side of the roller 51. A pressure feed block 57 is provided at the rear side of the roller 51. The pressure feed block 57 is fixedly mounted at a standstill in contact with the rear side of the roller 51. The block 57 is formed with two grooves E and F. As shown by broken line of FIG. 4, the grooves E and F are in the form of semicircular arc having a center of the rotational axis of the roller 51. On the other hand, the groove E is coupled with a suction device and the internal pressure thereof is always reduced. The other groove F is also coupled with the atmospheric pressure. Thus, when the tape feed roller 51 is rotated with respect to the stationary pressure feed block 57, the communicating holes 51*a* positioned on the groove E function as suction holes and can hold the tape 2 onto the periphery of the roller 51 is sucked manner (refer to FIG. 6). The communicating holes 51*a* positioned on the groove F and coupled with the atmospheric pressure have no suction function.

Guide pieces 58 are fixedly mounted on the peripheral end of both sides of the roller 51. The guide pieces 58 are provided so that the tape 2 held onto the periphery of the roller 51 is not removed.

As shown in FIG. 5, the welding roller 52 is supported at its rear surface by a supporting member 61, which is also fixedly mounted to a drive shaft 62. The periphery of the welding roller 52 is formed with a holding groove 52*a*, in which a length of resilient material 63 is held. Numeral 64 denotes a high-frequency welding electrode. The high-frequency welding electrode 64 is disposed on the surface of the resilient material 63 and both ends thereof are fixed to the welding roller 52 by bolts. As shown in FIG. 2, a power supply member 70 such as a carbon brush is slidably disposed to the rear surface of the welding roller 52 while being in contact with the roller 52. Thus, a high-frequency electric power is supplied from the power supply member 70 through the welding roller 52 formed of conductive material to the high-frequency welding electrode 64. Further, the tape feed roller 51 is formed of conductive material. Thus, the high-frequency welding electrode 64 functions as a positive electrode and the periphery of the tape feed roller 51 functions as a negative electrode.

The cutting device 53 includes a rotating base 67 fixedly mounted to a drive shaft 66, a cutter holder 68 supported on the surface of the rotating base 67, and a cutter 73 held by the cutter holder 68. The cutter holder 68 is slidably supported by the rotating base 67 so that the cutter 73 advances and retreats with respect to the rotating base 67. A stationary block 69 is provided behind the cutter holder 68 in spaced manner. As shown in FIG. 6, the stationary block 69 is fixedly mounted to the rotating base 67 by bolts 71. An adjustment bolt 72 is coupled between the stationary block 69 and the cutter holder 68. The adjustment bolt 72 adjusts the position of the cutter holder 68 so that an amount of protrusion of the edge of the cutter 73 is adjusted. In the proper protrusion position of the edge is the cutter 73, the edge of the cutter 73 abuts against the periphery of the tape feed roller 51 with proper pressure.

Figure 7:
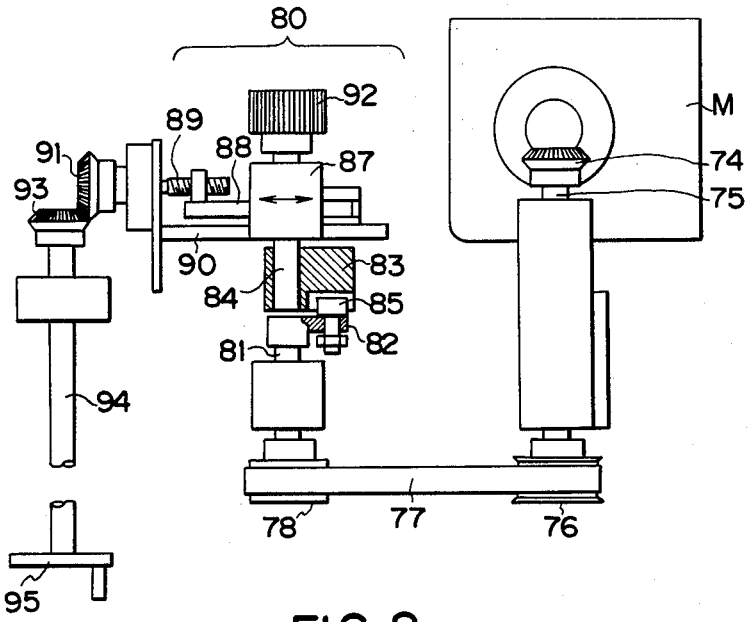
FIG. 7 is a plan view showing a variable-speed transmission mechanism.
Figure 8:
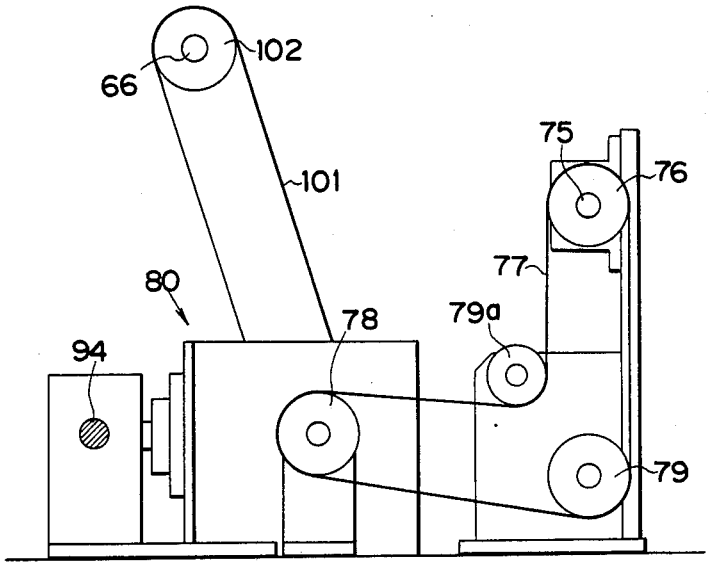
FIG. 8 is a front view of the variable-speed transmission mechanism.

FIG. 3 shows the structure of the power transmission mechanism $B_2$ disposed at the rear side of the unit base 30 of the welding device B as seen through the unit base 30 from the front surface of the base. FIG. 8 is a reduced front view of a lower half of the power transmission mechanism $B_2$ shown in FIG. 3. FIG. 7 is a plan view of the mechanism of FIG. 8.

The drive power of the welding device B is derived from motor M forming a drive source of the filling and packing device C. As shown in FIG. 7, the output power of the motor M is transmitted to a power transmission shaft 75 through a bevel gear 74. A toothed pulley 76 is fixedly mounted to the other end of the transmission shaft 75 and the toothed pulley 76 is coupled with an input pulley 78 through a toothed belt 77. Numeral 79 denotes an intermediate pulley and numeral 79a denotes a tension pulley (FIG. 8). The output power of the motor transmitted to the input pulley 78 is fed to a variable-speed transmission mechanism 80.

Figure 9:
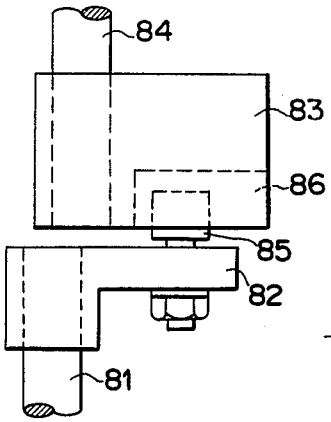
FIG. 9 is a partial plan view showing a main portion of the variable-speed transmission mechanism.

As shown in FIG. 7, in the variable-speed transmission mechanism 80, the motor power supplied through the input pulley 78 is transmitted to an input arm 82 through an input shaft 81. The input arm 82 is opposed to an output shaft 83 with a predetermined space therebetween and an output shaft 84 is fixedly mounted to the output arm 83. As shown in FIG. 9 in enlarged manner, the input arm 82 supports a coupling roller 85 and the output arm 83 is formed with a coupling groove 86 into which the coupling roller 85 is fitted. As shown in FIG. 7, the output shaft 84 supports a slider 87. The slider 87 is supported on a stationary base 90 slidably in right and left directions in the figure. A drive arm 88 is integrally mounted to the slider 87 and the drive arm 88 is coupled with a screw pin 89 in meshing engagement manner. A bevel gear 91 is fixedly mounted to the screw pin 89. The bevel gear 91 is meshed with another level gear 93 which is fixedly mounted to an adjustment shaft 94 to which an adjustment handle 95 is integrally mounted.

Figure 10:
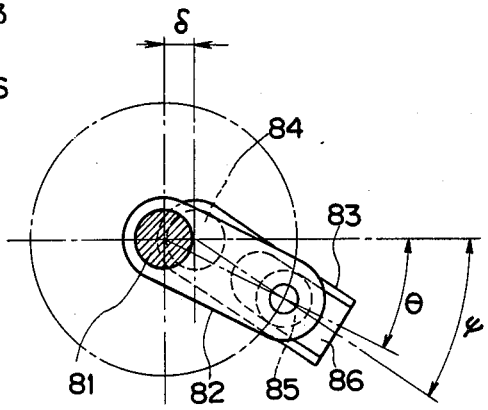
FIG. 10 is a partial front view showing a main portion of the variable-speed transmission mechanism.
Figure 11:
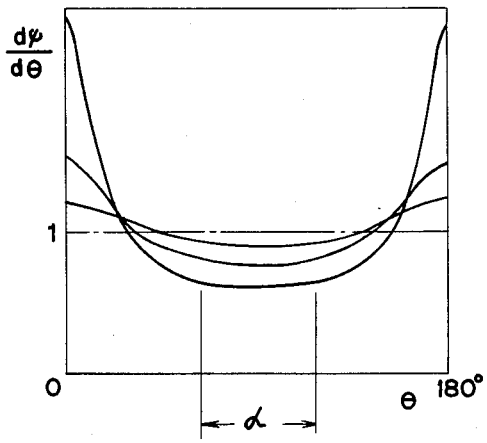
FIG. 11 is a graph showing variation of relative angular velocity at an output side versus an input side by the variable-speed transmission mechanism.

When the adjustment handle 95 is rotated, the screw pin 89 is rotated through the bevel gears 93 and 91 to move the slider 87 in right and left directions. As shown in FIG. 10, when the slider 87 is moved and the output shaft 84 is moved together with the slider, a deviation $\delta$ is produced between the rotational centers of the input arm 82 and the output arm 83. The deviation of the rotational centers of both the arms 82 and 83 varies the rotational output of the motor supplied through the input pulley 78 and the varied rotational output is produced from the output shaft 84 and the output pulley 92. The deviation of the rotational centers of the arms 82 and 83 varies the relative angular velocity of the input arm 82 and the output arm 83 in accordance with the rotational angle thereof. The ordinate axis of the graph of FIG. 11 represents the relative angular velocity of the output arm 83 to the input arm 82, that is, the relative angular velocity $d\psi/d\theta$ where the rotational angle of the input arm 82 is $\theta$ and the rotational angle of the output arm 83 is $\psi$. The abscissa axis represents the rotational angle $\theta$ of the input arm 82. It is apparent from the graph of FIG. 11 that the relative angular velocity ($d\psi/d\theta$) is varied in accordance with the rotational angle $\theta$ of the input arm 82. The relative angular velocity approximates zero in the range shown by $\alpha$ of the graph. More particularly, in the range $\alpha$, the output arm 84 is rotated at an angular velocity slower than the angular velocity (the angular acceleration thereof is zero) of the rotational power supplied from the motor M and at a velocity approximating to a constant velocity (the angular acceleration thereof is zero). The variable-speed output from the output pulley 92 is transmitted to the tape feed roller 51 and the welding roller 51 through the transmission system described later, and the high-frequency welding electrode 64 is brought into contact with the film 1 at a substantially constant rotational speed if the electrode 64 is adapted to be brought into contact with the film 1 in the range $\alpha$ shown in FIG. 11. When the adjustment handle 95 is rotated to vary the deviation $\delta$ of the input arm 82 and the output arm 83, the graph of the relative angular velocity shown in FIG. 11 can be varied continuously and hence the angular velocity at the time when the output arm 83 is rotated at a constant speed (in the range $\alpha$) can be varied. Accordingly, when the deviation $\delta$ is selected by the adjustment handle 95, the velocity of the rollers 51 and 52 at the time when the high-frequency welding electrode 64 is brought into contact with the film 1 can be freely varied in accordance with the feeding velocity of the film 1 and the welding electrode 64 can be brought into contact with the film 1 at a constant speed.

As shown in FIGS. 3 and 8, the output of the output pulley 92 of the variable-speed transmission mechanism 80 is transmitted to a follower pulley 102 through a toothed belt 101. The follower pulley 102 is fixedly mounted to the drive shaft 66 of the cutting device 53. A gear 103 is fixedly mounted to the drive shaft 66 of the cutting device 53. A gear 104 meshed with the gear 103 is fixed to the drive shaft 56 of the tape feed roller 51 and a gear 105 meshed with the gear 104 is mounted to the drive shaft 62 of the welding roller 52. The gears 103, 104 and 105 have the same in the number of teeth and the output transmitted to the cutting device from the variable-speed transmission mechanism 80 is transmitted to the tape feed roller 51 and the welding roller 52 with the same rotational number.

A pulley juxtaposed with the follower pulley 102 is mounted to the drive shaft 66 of the cutting device 53 and a toothed belt 106 passing round the pulley is coupled with a pair of pulleys 107 and 108. Numeral 109 denotes a tension pulley in the transmission system. The pulley 107 is fixedly mounted to a shaft 110 of a tape feed roller 35. The pulley 108 is fixedly mounted to a shaft 117 of the other feed roller 34. The pulley 107 is slightly smaller in diameter than the the pulley 108. Accordingly, the rotational number of the feed roller 35 is slightly larger than that of the feed roller 35. Thus, as described above, the difference between the rotational numbers of the rollers 34 and 35 removes creases and slack. Further, a gear 111 is fixed to the shaft 110 of the roller 35 and a gear 113 meshed with the gear 111 is fixed to the shaft 112 of the pinch roller 39. A gear 116 is fixed to the shaft 117 of the feed roller 34 and a gear 115 meshed with the gear 116 is fixed to the shaft 114 of the pinch roller 38. The pinch roller 39 is rotated with the same rotational number as that of the roller 35 and the pinch roller 38 is rotated with the same rotation number as that of the feed roller 34.

The drive shaft 62 to which the welding roller 52 and the gear 105 are fixed is supported to a pressurizing arm 121. The arm 121 is swingably supported to the unit bace 30 by a support shaft 122. The arm is depressed downward by a compression spring 123 and is pulled up by an extension spring 124. The depressing force of the compression spring 123 can be adjusted by an adjustment screw 125 and the pulling force of the extension spring 124 can be adjusted by an adjustment screw 126. The pressure of the welding electrode 64 provided in the welding roller 52 to the tape feed roller 51 can be properly established by adjustment of the resilient forces of both the springs 123 and 124. As shown in FIG. 3, a stopper 127 is disposed opposite to an end of the arm 121 so that the limitation of the downward movement of the arm can be adjusted.

Further, as shown in FIG. 2, a release arm 131 is disposed on the front surface of the unit base 30. A lever 132 is mounted to the support shaft 122 supporting the arm 121. When the release arm 131 is thrown down, the lever 132, the support shaft 122 and the arm 121 are rotated together and the welding roller 52 is separated from the tape feed roller 51.

Operation is now described.

As shown in FIG. 1, the film 1 is pulled out from the film roll 1*x* and is sent out by the feed roller 11 at the constant speed. The film 1 is then led by the guide rollers 12 to be fed in the welding device B. The film 1 is guided by the guide rollers 31*a* to 31*d* and passed through the welding device B at the constant speed.

On the other hand, as shown in FIGS. 7 and 8, the output of the motor M which is a common power source of the welding device B and the filling and packing device C is transmitted to the input pulley 78 of the variable-speed transmission mechanism 80 through the toothed belt 77. The motor output is varied in speed in the variable-speed transmission mechanism 80 and is produced from the output pulley 92. The degree of the variation in speed of the motor output can be adjusted by rotation of the adjustment handle 95. When the adjustment handle 95 is rotated, the slider 87 is moved in right and left direction in FIG. 7 to establish the deviation $\delta$ of the rotational centers of the arms 82 and 83 (refer to FIG. 10). The deviation of the arms 82 and 83 varies the relative angular speed of the output arm 83 to the input arm 82 as shown in the graph of FIG. 11.

The output from the variable-speed transmission mechanism 80 is transmitted from the output pulley 92 to the follower pulley 102 through the toothed belt 101. As shown in FIG. 3, the drive shaft 66 is driven by the follower pulley 102 and the drive shafts 56 and 62 are driven by the gears 103, 104 and 105. That is, the cutting device 53 and the welding roller 52 are rotated counterclockwise and the tape feed roller 51 is rotated clockwise by the output from the variable-speed transmission mechanism 80. The power transmitted to the follower pulley 102 is further transmitted to the pulleys 107 and 108 through the toothed belt 106 so that the feed rollers 35 and 34 of the tape 2 are rotated counterclockwise. Further, the pinch rollers 39 and 38 are driven clockwise by the gears 111 and 113 and the gears 116 and 115, respectively.

As shown in FIG. 6, the elongated tape 2 is sent out by the feed rollers 34 and 35 and is fed to the periphery of the tape feed roller 51 through the rollers 36 and 37. As shown in FIGS. 4 and 5, when the multiplicity of communicating holes 51*a* provided in the tape feed roller 51 are moved to the left side, the holes 51*a* communicate with the groove E of the pressure feed block 57. Since the pressure within the groove E is reduced by the suction device not shown, the holes 51*a* communicating with the groove E function to hold the tape 2 positioned at the periphery of the tape feed roller 51 in the sucked manner. However, since the tape feeding speed by the feed rollers 34 and 35 is smaller than the rotational speed of the tape feed roller 51, the tape 2 slides on the periphery of the roller 51 while being held on the periphery of the roller 51.

When the edge of the cutter 73 held by the rotating cutting device 53 hits on the periphery of the roller 51, the tape 2 is cut by the edge of the cutter 73 into a strip of tape having a proper length suitable for a cut tape of the sticklike package. While the tape 2 cut into a strip is held on the periphery of the roller 51 in the sucked manner, the strip of tape 2 is sent to a position in which the tape 2 is brought into contact with the film 1 moving between the guide rollers 31*c* and 31*d* at a constant speed. At this time, the welding electrode 64 of the welding roller 52 is moved to a position in which the film 1 and the strip of tape are held between the welding electrode 64 and the roller 51. This timing is synchronized with the timing range $\alpha$ shown in the graph of FIG. 11 in the variable-speed operation by the variable-speed transmission mechanism 80. The angular acceleration of the relative angular velocity of the output arm 83 to the input arm 82 approximates zero in the range $\alpha$. Since the output arm 83 is rotated at substantially constant speed, the rotational angular speed of the rollers 51 and 52 is substantially constant when the welding electrode 64 comes in contact with the film 1. Further, when the adjustment handle 95 of the variable-speed transmission device 80 is rotated to vary the deviation $\delta$ in FIG. 10, the rotational angular velocity at the time when the welding roller 52 approximates the constant speed can be coincident with the moving speed of the film 1. Consequently, the difference of speed between the film 1 and the welding electrode 64 is not caused.

The tape 2*a* cut into the strip and the film 1 are welded to each other by a positive electrode formed of the high-frequency welding electrode 64 and a negative electrode formed of the tape feed roller 51 in accordance with the shape of electrode 64. After welded, the holes 51*a* formed in the roller 51 communicate with the atmospheric pressure through the groove F of the block 51 and accordingly the suction force acting on the strip of tape 2*a* is released.

The film 1 to which the strip of tape 2*a* has been welded by the welding device B is carried to the filling and packing device C through a phase adjustment mechanism 13. In the filling and packing device C, the film 1 is formed into a cylinder and is sealingly joined at opposed ends thereof by the electrode 22 while being carried by the rollers 24 at a constant speed. Then, the film 1 formed into a cylinder is filled with processed foodstuffs by the stuffer nozzle 23. The cylindrical film 1 filled with the processed foodstuffs is squeezed by the rollers 25 and is clipped with the clips 4 at the squeezed portions in the clipping mechanism 26 so that the inside of the cylindrical film 1 filled with the processed foodstuffs is sealed and is then cut in a predetermined length.

Figure 12:
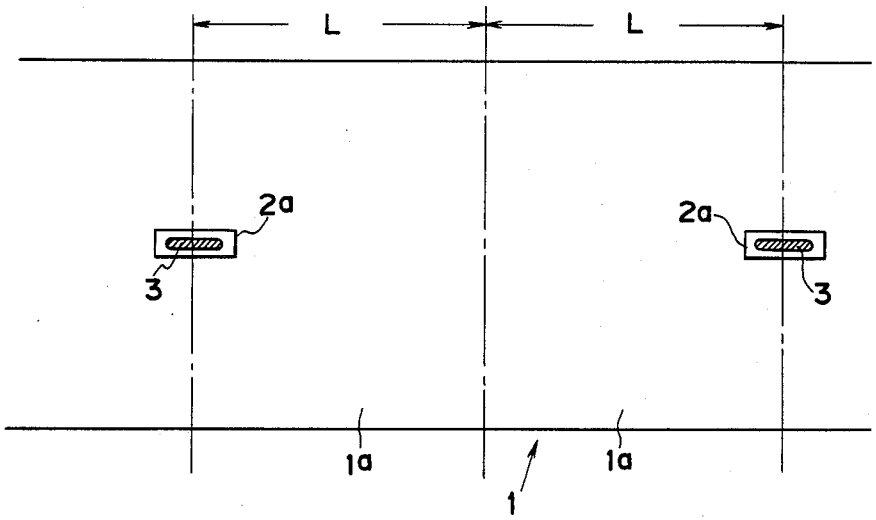
FIG. 12 is a plan view showing the strip of tape welded to the film.

In the filling and packing device C, when the cylindrical film 1 filled with the processed foodstuffs is clipped with the clips 4 in the clipping mechanism 26 and is cut, the strips of tape 2*a* must be positioned at the clipped and cut portions. Accordingly, the power sources of the welding device B and the filling and packing device C are the same motor M and both the devices B and C are operated in interlocked relationship with each other. More particularly, the reduction ratio of the power of the motor M is set so that the rollers 51 and 52 and the cutting device 53 are made one rotation while the squeezing rollers 25 and the clipping mechanism with the clips 4 in the filling and packing device C are operated by two cycles. While the speed of the roller 51 and the like is varied by the variable-speed transmission mechanism 80 as shown in FIG. 11, since the rotational number of the output from the variable-speed transmission mechanism 80 is not varied, the strips of tape 2*a* are welded to the film at intervals of (2×L) with respect to a unit length L of the package as shown in FIG. 12 by setting the reduction ratio. That is, while the operation of the squeezing rollers 25, the clipping mechanism and the cutting mechanism is made for each cycle of the length L of the package, the welding operation of the strip of tape 2*a* is made alternately with the clipping and cut portions.

Figure 14:
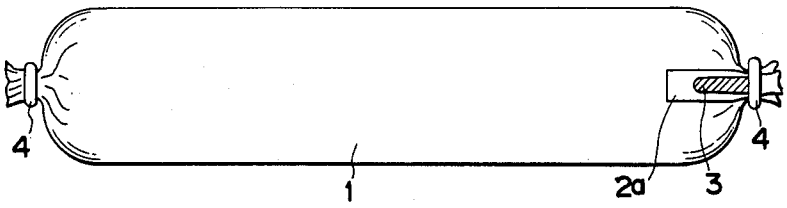
FIG. 14 is a front view showing a complete sticklike package.

Further, in the phase adjustment mechanism 13 shown in FIG. 1, the distance l between the stationary rollers 15*a*, 15*b* and the moving rollers 18*a*, 18*b* is varied to change the length of the film 1 extending between the welding device B and the filling and packing device C so that the welded portion of the strip of tape 2*a* can be positioned to meet the clipping of the fillng and packing device C and the operation timing of the cutting device. Thus, the middle portion of the strips of tape 2*a* welded at intervals of (2×L) as shown in FIG. 12 is exactly cut and the sticklike package having the strip of tape 2*a* welded in one side can be completed as shown in FIG. 14.

The power of the filling and packing apparatus is transmitted to the variable-speed transmission mechanism 80 at the rate of 1:1 without reduction and the tape feed roller 51 is effected one rotation during one cycle of the filling and packing device C so that the strip of tape 2*a* can be welded at intervlas of L in FIG. 12. In this case, the complete sticklike package is provided with the strips of tape at both ends thereof.

The apparatus can vary the unit length (L) of the complete sticklike package. This length may be adjusted only by variation of the moving speed of the film 1. Since the filling and packing device C is always operated in interlocked relationship with the welding device B at a constant cycle, if the moving speed of the film 1 is made slow, the welding pitch (2×L) of the strip of tape 2*a* is short and the clipping and cutting pitch (L) in the filling and packing device C is also short, whereby the unit length of the package is short. On the contrary, if the moving speed of the film 1 is made fast, the unit length of the package can be long.

Figure 13:
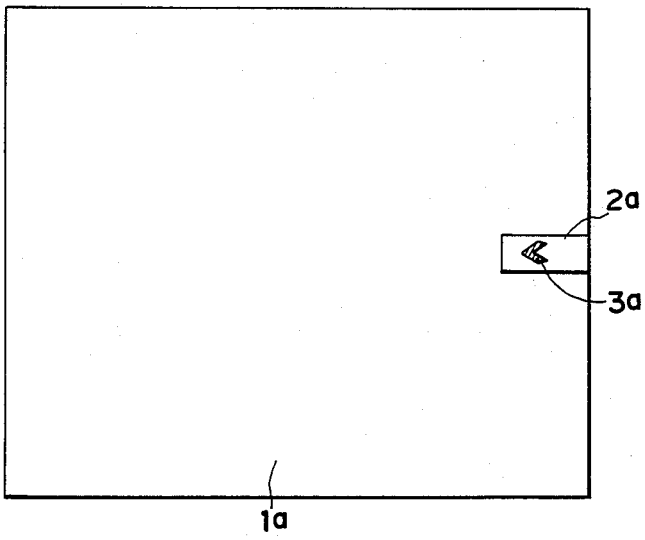
FIG. 13 is a plan view showing the tape welded to the film with a welding portion having a different shape from that of FIG. 12.

If the shape of the welding electrode 64 is changed, a partial welding portion 3*a* as shown in FIG. 13 can be made.

In the illustrated embodiment, since it is assumed that film made of vinylidene chloride is employed for the film 1, the high-frequency welding is adopted as means for welding the strip of tape 2*a*, while thermal welding means may be used.

Figure 15:
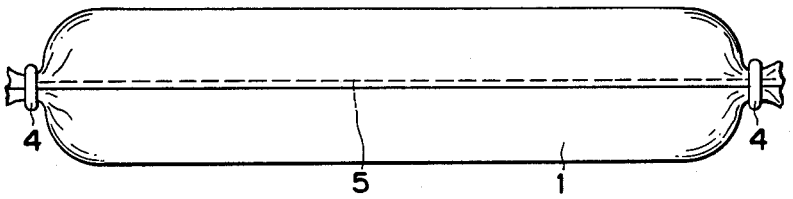
FIG. 15 is a rear view of the sticklike package shown in FIG. 14.
Figure 16:
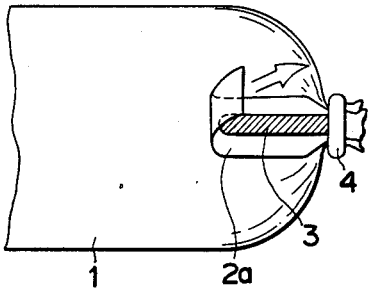
FIG. 16 is a partially enlarged view showing an end of the sticklike package to which the tape is welded.

The sticklike processed foodstuffs such as sausage manufactured by the above apparatus are formed as shown in FIGS. 14 to 16. This sticklike package is formed into a cylinder and includes opposed ends sealingly joined with each other at a seal line 5. The strip of tape 2*a* is fixed by a partially welded portion 3 at a fastened portion by the clip 4.

Figure 17:
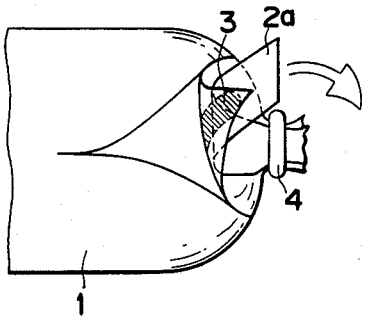
FIG. 17 is a partially enlarged view showing the film torn partially by the tape.

In order to remove the film 1 from the processed foodstuffs, an end of the cut tape 2*a* is held between fingers and is pulled up as shown in FIG. 16. Thus, the film 1*a* is torn from an end of the welded portion 3 as shown in FIG. 17 and the film 1*a* can be easily removed.

As described above, according to the present invention, the strips of tape can be welded to the film in spaced relationship with each other continuously and automatically, and the sausage packing film with the cut tape can be manufactured continuously. Sausage having the shape shown in FIG. 14 can be manufactured continuously in interlocked relationship with the filling device for the processed foodstuffs such as sausage. Since the tape is carried continuously and the strip of tape is welded to the film by the rotating tape feed roller and welding roller, when the filling and packing device for sausage is continuously disposed in the subsequent stage of the welding device of the film and the tape, the film can be continuously fed to the filling and packing device and the welded portion of the strip of tape to the complete package is not deviated. Further, since the film is carried continuously, both the welding operation of the strip tape and the filling and packing operation of sausage and the like can be made fast and the processing speed can be increased. Although a conventional structure in which the film is stopped to weld the strip of tape to the film requires a mechanism for removing a difference of the film feeding to meet continuous feeding of the film in the filling and packing device, the apparatus of the present invention does not require such a mechanism and is simple in structure with the filling and packing device integrated thereto. Further, the rotational speed of the tape feed roller and the welding roller is varied by the variable-speed transmission mechanism and the speed of the welding device is established to meet the moving speed of the film so that the strip of tape can be exactly welded to the film.

We claim:

1. An apparatus for welding a strip of tape to film comprising:

means for feeding the film continuously;

a tape feeding roller disposed opposite to one side of the film being fed by said film feeding means and including a periphery provided with means for holding the tape in sucked manner;

means for feeding the tape to the outside periphery of said tape feeding roller;

means for cutting the tape held by said tape feeding roller into a strip;

a welding roller disposed opposite to said tape feeding roller while holding the film therebetween and including at a periphery thereof means for welding the strip of tape to the film;

a variable-speed transmission mechanism in which an angular velocity of said tape feeding roller and said welding roller is varied to reduce an angular acceleration of said tape feeding roller and said welding roller to substantially zero so that the angular velocity of the rollers is coincident with the feeding velocity of the film when the strip of tape held by said tape feeding roller is welded to the film, said variable-speed transmission mechanism comprising an input arm which is rotated by power of a motor and an output arm for transmitting power to said tape feeding roller and said welding roller, both said arms being coupled through coupling means separated from a rotational center, and said transmission mechanism including adjustment means for varying deviation between a rotational center of said output arm and a rotational center of said input arm; and a power transmission mechanism for rotating said tape feeding roller and said welding roller in synchronism.

2. An apparatus according to claim 1, wherein said cutting means includes a cutter which is rotated in synchronism with said tape feeding roller and including an edge which abuts against the periphery of said tape feeding roller on the way of rotation.

3. An apparatus according to claim 1, wherein said means for holding the tape includes communicating holes formed in an outside periphery of said tape feeding roller in spaced manner and a pressure feed block being in contact with a plane side of said tape feeding roller and including a suction groove communicating with said holes, thereby the strip of tape is held by suction of said suction groove until the strip of tape is welded to the film.

4. An apparatus according to claim 1, wherein said welding means comprises a high-frequency welding electrode and said tape feeding roller forms a mating electrode to the high-frequency welding electrode.

5. An apparatus according to claim 4, wherein said welding means is mounted to an outside periphery through resilient material.

6. An apparatus according to claim 1, further comprising a pair of feed rollers for feeding the tape to the outside periphery of said tape feeding roller, and rotational speed of one of said feed rollers disposed upstream is lower than that of the other disposed downstream so that creases of the tape is removed by a difference of the speed between both said feed rollers.

* * * * *